US010934606B2

(12) United States Patent
Rupert et al.

(10) Patent No.: US 10,934,606 B2
(45) Date of Patent: Mar. 2, 2021

(54) ENHANCING MECHANICAL PROPERTIES OF NANOSTRUCTURED MATERIALS WITH INTERFACIAL FILMS

(71) Applicant: The Regents of the University of California, Oakland, CA (US)

(72) Inventors: Timothy J. Rupert, Irvine, CA (US); Amirhossein Khalajhedayati, Foothill Ranch, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 290 days.

(21) Appl. No.: 15/896,849

(22) Filed: Feb. 14, 2018

(65) Prior Publication Data

US 2018/0230573 A1 Aug. 16, 2018

Related U.S. Application Data

(60) Provisional application No. 62/459,987, filed on Feb. 16, 2017.

(51) Int. Cl.
*C22C 1/00* (2006.01)
*C22C 45/00* (2006.01)

(52) U.S. Cl.
CPC ..... *C22C 1/002* (2013.01); *C22C 45/00* (2013.01); *C22C 45/001* (2013.01)

(58) Field of Classification Search
CPC ..... C22C 1/002; C22C 45/001
USPC ..... 420/492; 148/561
See application file for complete search history.

(56) References Cited

U.S. PATENT DOCUMENTS 4,564,396 A * 1/1986 Johnson ..... C22C 45/00 148/403
7,591,913 B2 * 9/2009 Ren ..... C22C 1/005 148/512
2008/0128055 A1 * 6/2008 Chu ..... C22C 45/00 148/518

OTHER PUBLICATIONS

J.A. Sharon et al., Interpreting the ductility of nanocrystalline metals. J. Mat. Research. 28, 12 (2013) pp. 1539-1552.
K. Lu et al., Microhardness and fracture properties of nanocrystalline NiP alloy. Scripta Metallurgica et Materialia, vol. 24, Issue 12, Dec. 1990, pp. 2319-2323.
L. Lu et al., Ultrahigh Strength and High Electrical Conductivity in Copper. Science 304, 5669 (2004) pp. 422-426.
I.S. Choi et al., Mechanics of indentation of plastically graded material. J. Mech. Phys. Sol. 56, 1 (2008) pp. 157-183.
(Continued)

*Primary Examiner* — Nicholas A Wang
(74) *Attorney, Agent, or Firm* — Nguyen Tarbet LLC

(57) ABSTRACT

Nanostructured materials that contain amorphous intergranular films (AIFs) are described herein. Amorphous intergranular films are structurally disordered (lacking the ordered pattern of a crystal) films that are up to a few nanometers thick. Nanostructured materials containing these films exhibit increased ductility, strength, and thermal stability simultaneously. A nanocrystalline material system that has two or more elements can be designed to contain AIFs at the grain boundaries, provided that the dopants segregate to the interface and certain materials science design rules are followed. An example of AIFs in a nanostructured Cu—Zr alloy is provided to illustrate the benefits of integrating AIFs into nanostructured materials.

14 Claims, 6 Drawing Sheets

(56) References Cited

OTHER PUBLICATIONS

T. Chookajorn et al., Design of Stable Nanocrystalline Alloys. Science, 24, 337 (2012).
Pan, Z. & Rupert, T. J. Damage nucleation from repeated dislocation absorption at a grain boundary. Comput. Mater. Sci. 93, 206 (2014).

* cited by examiner

ENHANCING MECHANICAL PROPERTIES OF NANOSTRUCTURED MATERIALS WITH INTERFACIAL FILMS

CROSS REFERENCE

This application claims priority to U.S. Provisional Patent Application No. 62/459,987, filed Feb. 16, 2017, the specification(s) of which is/are incorporated herein in their entirety by reference.

GOVERNMENT SUPPORT

This invention was made with government support under Grant No. W911NF-12-1-0511 awarded by the U.S. Army Research Office. The government has certain rights in the invention.

FIELD OF THE INVENTION

The present invention relates to methods for enhancing strength, ductility, and thermal stability of nanostructured materials, namely, by forming amorphous intergranular films (AIFs) in the nanostructured materials.

BACKGROUND OF THE INVENTION

Nanostructured materials, sometimes also called nanocrystalline or ultra-fine grained materials, are a category of materials with an average crystallite size that is sub-micron (i.e., in the nanometer range). A nanostructured material's key technological advantage is an order of magnitude higher strength when compared to traditional counterparts having larger crystal sizes. This advantage is important in many applications such as defense, aerospace, and auto industries where materials experience high stress levels and must resist permanent deformation. However, the application of nanostructured materials has been very limited due to the instability of the small crystal structure at high temperatures and loss of the typical ductile behavior expected under loading (e.g., drawing of Cu into a wire) [1]. Performance at high temperatures may be important for use in many technological applications but also for materials-forming processes, where temperature is used in conjunction with force to shape a material. Ductility is important for averting engineering structures from failing catastrophically, and allowing a material to be formed into a final shape. Currently, the aforementioned problems hold nanocrystalline metals in the research stage and in applications where the true advantages of these materials are not utilized.

Current solutions to thermal instability include addition of second phase particles and doping of crystal boundaries with elements that segregate to these features. Unfortunately, these solutions often degrade the ductility of nanostructured materials even more [2]. Current strategies for improving the ductility of nanostructured materials include adding special types of crystal boundaries called twins [3] or adding a spatial gradient of grain size to resist strain localization [4]. The addition of twins is limited to certain pure, single element materials, while gradient nanostructures have no added thermal stability. From the discussion above, a different approach is necessary to manipulate the interfacial regions of nanocrystalline materials to access both types of novel properties (thermal stability and mechanical) and address the problems such as unstable grain structure and lack of ductility. The current invention takes advantage of dopant segregation to introduce a new type of crystal boundary structure, an amorphous intergranular film (AIF), in nanostructured materials that has the potential to address many of the current challenges in the field.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention discloses a new class of nanomaterials or nanostructured materials with tunable grain boundary structure and methods of generating said materials. As will be described herein, a tunable grain boundary structure is formed by a plurality of amorphous intergranular films (AIFs) within the nanostructured material.

In some aspects, the present invention discloses a method for increasing thermal stability and ductility of a nanostructured material, said nanostructured material comprising a base material in a form of a plurality of crystallites each having a boundary ("crystallite boundary") defining a crystalline interior. The method includes selecting a dopant element compatible with the base material such that the dopant element and the base material may be immiscible, the dopant element may include a negative heat of mixing, an atomic size difference between the dopant element and the base material may be sufficiently large to encourage disorder at the crystallite boundaries of the nanostructured material, and metallic bonding may be retained at the crystallite boundary. In other aspects, the method may include mixing the dopant element and the base material to produce a supersaturated solid material alloy, wherein the dopant element is dispersed throughout the crystallite boundaries and crystalline interiors, and applying a first heat treatment to the supersaturated solid material alloy to provide thermal energy sufficient to induce diffusion of the dopant element to the crystallite boundaries, wherein the crystalline interiors may be substantially depleted of the dopant element after application of the first heat treatment.

Additionally or alternatively, the method may include applying a second heat treatment to create an amorphous liquid-like structure at the crystallite boundaries, wherein the amorphous liquid-like structure comprises the dopant element and the base material (wherein the crystalline interiors remains solid during the second heat treatment and quenching the supersaturated solid material alloy to freeze the amorphous liquid-like structure, thus forming amorphous intergranular films (AIFs) at the crystallite boundaries. Segregation of the dopant element via the diffusion of the dopant element to the crystallite boundaries may lower a crystal boundary energy, thereby making the nanostructured material stable at high temperatures, and the formation of the AIFs at the crystallite boundaries of the nanostructured material may increase both strength and ductility of the nanostructured material as compared to materials lacking AIFs.

In some embodiments, the mixing may include agitating and co-deforming powders of the base material and the dopant element to mechanically mix the base material and the dopant element. The agitating and co-deforming may be performed using a ball-milling instrument. Applying the first heat treatment may include annealing the supersaturated solid material alloy at a first temperature for a first threshold time and wherein applying the second heat treatment may include annealing the supersaturated solid material alloy at a second temperature for a second threshold time. The second temperature may be greater than or equal to the first temperature. Additionally or alternatively, the method may further include selecting the first temperature, the second temperature, the first threshold time, and the second threshold time based on one or more of the base material, the dopant element, and a phase diagram of the supersaturated solid material alloy. The supersaturated solid material alloy may include two or more dopant elements. The supersaturated solid material alloy may include two or more base materials. The dopant element may include Zr, Fe, Co, Ni, Rh, Pd, Pt, or other non-transition or transition metals. The base material may include Cu, Fe, steel, Ni, Ti, other transition metals, Al, Mg, or other non-transition metals.

According to some embodiments, a method of forming an amorphous intergranular film ("AIF") surrounding crystallite structures of a base material of a nanostructured material is provided. The crystallite structure comprises a crystalline interior having a grain boundary. The method includes mixing a dopant element to the base material to form a solid material alloy. Herein, the dopant element may be selected based on an ability of the dopant element to segregate to the grain boundary of the base material, the dopant element and the base material being immiscible; and an atomic size difference between the dopant element and the base material being sufficiently large to encourage disorder at the crystallite boundaries of the nanostructured material.

The method may further include applying a heat treatment to the solid material alloy to preferentially segregate the dopant element to the grain boundary and to selectively melt an interfacial mixture at the grain boundary to form a liquid-like structure at the grain boundary. Additionally or alternatively, the method may include quenching the solid material alloy to freeze the liquid-like structure of the interfacial mixture at the grain boundary, while maintaining the crystalline interior solid. As such, the AIF formed at the grain boundary of the base material may enhance strength, ductility, and thermal stability of the nanostructured material. Applying the heat treatment may include annealing the solid material alloy at a threshold temperature for a threshold time to diffuse the dopant element to the grain boundary of the base material and melt the dopant element and the base material in the interfacial mixture to form the AIF at the grain boundary. The threshold temperature may be adjusted based on a melting temperature of each of the base material and the dopant element. The base material may include copper ("Cu"), and the dopant element may include comprises zirconium ("Zr") and the solid material alloy may be a Cu-3 atomic percent Zr alloy.

In yet other aspects, a nanocrystalline structure comprising a copper-zirconium ("Cu—Zr") alloy of Cu with about 3 atomic % Zr is provided. The nanocrystalline structure may be in a form of a crystalline interior comprised primarily of Cu surrounded by grain boundaries comprising amorphous intergranular films ("AIFs") of the Cu—Zr alloy. Herein, Zr may have a negative heat of mixing and may be immiscible with Cu. Zr may maintain metallic bonding at the grain boundaries and an atomic size difference of Zr and Cu may encourage disorder at the grain boundaries of the nanocrystalline structure. The AIF at the grain boundaries may enhance strength, ductility, and thermal stability of the nanocrystalline structure. The AIFs may be formed by annealing the Cu—Zr alloy at a first temperature, the annealing causing Zr to diffuse to the grain boundary and further includes melting Cu and Zr at the grain boundary to form a liquid-like structure. Additionally or alternatively, forming the AIFs may include rapidly quenching from the first temperature to a second temperature to freeze the liquid-like structure at the grain boundary. The first temperature may be selected based on one or more of a melting temperature of pure Cu, a solidus temperature of the Cu—Zr alloy, and a Cu—Zr phase diagram. The first temperature may be about 950° C. and the second temperature may be about room temperature.

One of the unique and inventive technical features of the present invention is the selection of dopant element that is compatible with the base material such that the dopant element and the base material are immiscible, the dopant element may include a negative heat of mixing, an atomic size difference between the dopant element and the base material may be sufficiently large to encourage disorder at the crystallite boundaries of the nanostructured material, and metallic bonding may be retained at the crystallite boundary formation of AIFs. Without wishing to limit the invention to any theory or mechanism, it is believed that the technical feature of the present invention advantageously allows for the formation of AIFs in the nanostructured materials that results in increased ductility and toughness of the nanostructured metals without sacrificing any strength, thus, breaking the paradigm of a direct strength-ductility trade-off that has dominated prior observations. None of the presently known prior references or work has the unique inventive technical feature of the present invention.

In fact, the current scientific thinking is that the amorphous intergranular films would be impossible in metallic alloys. For example, metals have metallic bonding considered to be simpler than ceramics, which have a more complex chemistry with covalent and ionic bonding. This led to some disbelief that it would be possible to make the type of nanomaterials of the present invention. Further still, grain boundary pre-melting, which is used in the present invention, was not thought to be possible. Unexpectedly and surprisingly, the present invention not only achieved the formation of stable AIFs, but also used grain boundary pre-melting to effectively form the AIFs in the nanostructured materials.

Moreover, the enhanced ductility of the AIFs in the nanostructured material of the present invention was in itself another unexpected feature. Traditionally, amorphous materials are very brittle, (e.g., window glass). In fact, amorphous metals or metallic glasses are extremely brittle on their own. Based on this traditional thinking, it was believed that adding AIFs would make the nanostructured material worse. However, contrary to this current teaching, the present invention was successfully able to achieve nanostructured materials with enhanced strength and ductility by selective formation of AIFs at grain boundaries.

Some of the challenges that were successfully overcome in designing the experiments that led to the formation of the AIFs include finding the correct chemistries that allow for grain boundary segregation and the reduction of the energy penalty for an amorphous phase. While performing the experiments, a unique and inventive quench process was developed, which included quenching in the phases that are only stable at high temperatures, relatively close to the melting point.

Further advantages of the present invention include flexibility and scalability. For example, the method for generating the nanomaterials creates a wide variety of chemistries while also being scalable so that the materials may be used to produce bulk quantities of material. The criteria for materials selection implemented in the present invention, such as segregation and lowering of the energy penalty of the AIF, may be applied to other systems. For instance, the materials used to produce the AIFs in nanostructured materials are from powder metallurgy techniques. As such, powder metallurgy can be used to make large or bulk parts.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

The features and advantages of the present invention will become apparent from a consideration of the following detailed description presented in connection with the accompanying drawings in which:

FIG. 2A shows a schematic of a microstructure of a base material such as pure copper (Cu) powder. FIG. 2B shows a schematic of the microstructure after a dopant element (such as zirconium (Zr)) is completely homogenously mixed with the base material. FIG. 2C shows the dopant element segregating to the grain boundaries of base material nanostructure after a first heat treatment is applied. FIG. 2D shows the formation of AIF at the grain boundaries after the nanocrystalline sample is melted and subsequently quenched.

FIG. 7A shows a pure Cu nanostructure under a compressive force. FIG. 7B shows a pure Cu nanostructure under a first bending force. FIG. 7C shows a pure Cu nanostructure under a second bending force. FIG. 7D shows a mixed Cu—Zr nanostructure under the compressive force. FIG. 7E shows a mixed Cu—Zr nanostructure under the first bending force. FIG. 7F shows a mixed Cu—Zr nanostructure under the second bending force. FIG. 7G shows a nanostructured Cu—Zr material with AIFs under the compressive force. FIG. 7H shows a nanostructured Cu—Zr material with AIFs under the first bending force. FIG. 7I shows the nanostructured Cu—Zr material with AIFs under the second bending force.

DETAILED DESCRIPTION OF THE INVENTION

Figure 1:
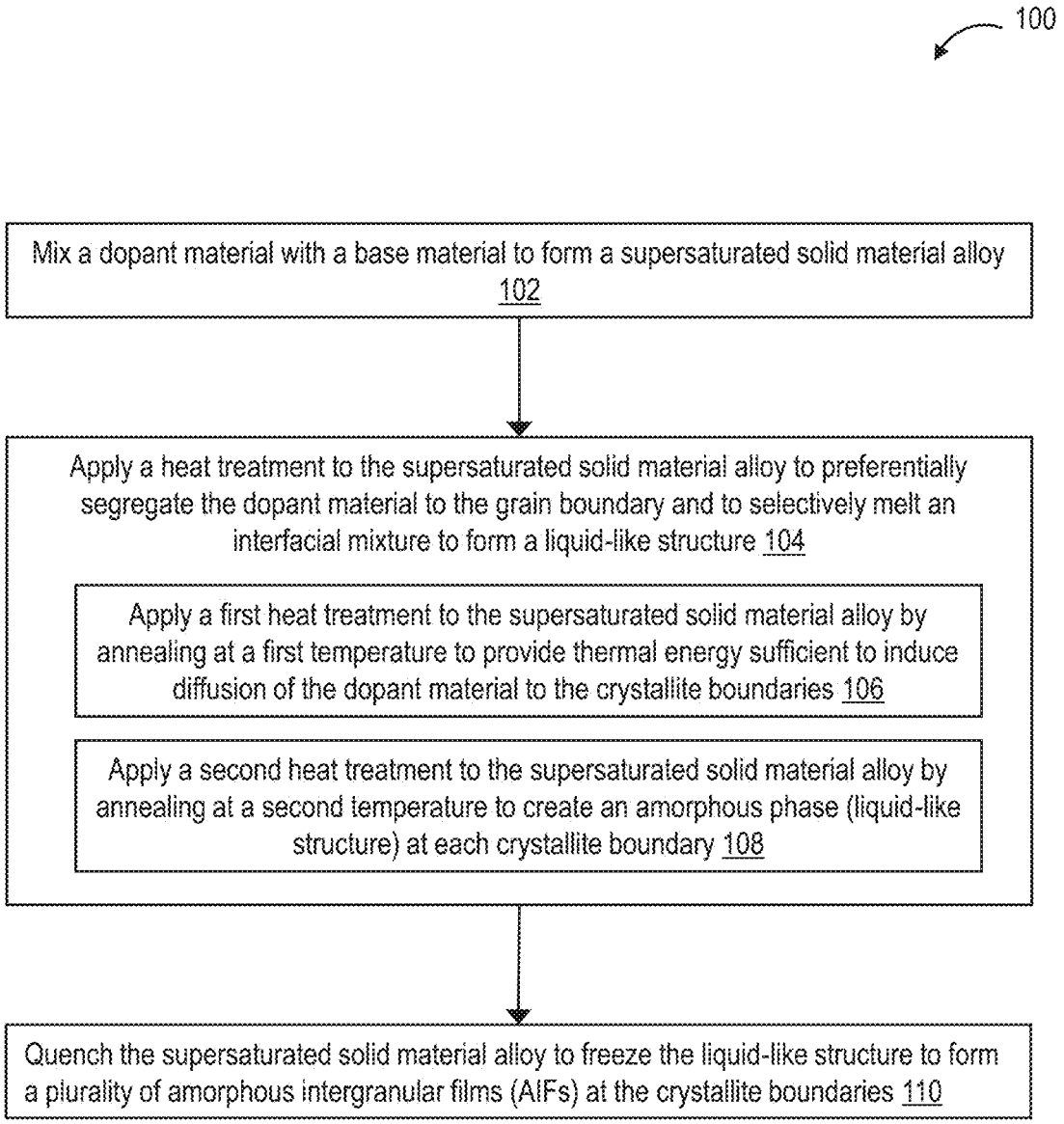
FIG. 1 shows a flowchart illustrating an example method for increasing strength, ductility, and thermal stability of a nanocrystalline sample by forming a plurality amorphous intergranular film (AIF) along grain boundaries of the nanocrystalline sample.

Following is a list of elements corresponding to a particular element referred to herein:

100 method
102 mix dopant element with base material
104 heat treatment
106 first heat treatment
108 second heat treatment
110 quench
200 schematic representation
202 crystalline interior
204 grain boundary
206 base material
208 dopant element
210 amorphous intergranular film (AIF)
214 nanostructured material
216 solid material alloy
218 interfacial mixture
302 TEM image
304 TEM image
306 EDS profile
402 TEM image
404 TEM image
406 EDS profile
502 image
602 image
604 area
606 interface
608 area
610 Fast Fourier Transform (FFT) pattern
612 FFT pattern
614 FFT pattern
802 plot
804 plot Referring now to FIGS. 1-8, the present invention features a method for increasing thermal stability and ductility in a nanostructured material. FIG. 1 shows an example method 100 for increasing the thermal stability and ductility in a nanostructured material by forming a plurality of amorphous intergranular films (AIFs) within the material. FIGS. 2A-2D show a schematic representation 200 of the example method 100. As such, the nanostructured material (214) may comprise a set of crystallites each having a boundary ("grain or crystallite boundary") (204) defining the exterior of the crystallite. At 102, method 100 comprises mixing a dopant element (208) with a base material (206) to produce a supersaturated solid material (216). The dopant element may be selected based on several factors. As an example, the dopant element may be selected based on ability of the dopant element to segregate to the grain boundaries in the base material (206). The dopant element may include a negative heat of mixing, e.g. heat is released when mixing occurs, such that an exothermic mixing occurs when the dopant element is mixed with the base material, for example. As such, the exothermic mixing results in energy being released, which means that the bonding between the base material and the dopant element is favorable. In addition, the dopant element may be selected such that a large atomic radius mismatch exists between the dopant element and base material. More specifically, the difference between the atomic sizes of the dopant element and the base material may be sufficient to encourage disorder at each crystallite boundary within the nanostructured material. As a non-limiting example, if the atomic radius mismatch between the dopant element and the base material is at least 12%, then the AIF that is formed may be sustained. While some size mismatch is needed for segregation, in some embodiments, sustained AIF formation can be achieved with smaller mismatches that are less than 12%.

In some example embodiments, the dopant element may be selected such that a solubility of the dopant material is lower compared to the base material, so that the solid material formed when the dopant element is mixed with the base material, is supersaturated. As an example, when Zr is mixed with Cu, since Zr has negligible solubility (about 0.12 atomic %) in the Cu lattice, the Cu—Zr structure may be referred to as a supersaturated solid solution. Supersaturated solution implies that the lattice of the nanostructured material has more of the dopants than it can handle energetically. As Without wishing to limit the invention to a particular mechanism, the supersaturation of the solution may provide a driving force for segregation of the dopant elements to the grain boundaries.

At 102 of method 100, the dopant element (208) and the base material (206) may be mechanically mixed to generate a solid material alloy (216). The solid material alloy may be interchangeably referred to as the supersaturated solid material. Alternate embodiments feature two or more dopant elements and/or two or more base materials comprising the supersaturated solid.

Herein, the mixing may include agitating and co-deforming powders of the base material (206) and the dopant element (208) to mechanically mix the base material and the dopant material. In a non-limiting embodiment, the agitating and co-deforming to produce the solid material alloy (216) may be produced by using a ball milling instrument. As such, mechanical alloying with a high-energy ball mill produces powders with particle sizes of micrometer-scale diameter, with each particle containing many individual nanometer-scale grains. Other non-limiting example of methods of producing the solid material alloy include severe plastic deformation techniques such as planetary milling, equal channel angular pressing (ECAP), equal channel angular extrusion (ECAE), and high pressure torsion (HPT). Additional techniques to produce the solid material include deposition techniques, such as sputter deposition, evaporation, or electrodeposition.

At 104, method 100 may include applying a heat treatment to the supersaturated solid material alloy (216) to provide thermal energy sufficient to induce diffusion of the dopant material (208) to the grain boundaries (204) and to selectively melt an interfacial mixture (218) at the grain boundary (204). As such, the interfacial mixture (218) may include base material (206) already existing at the grain boundary (204) mixed with the dopant material (208) that has diffused to the grain boundary (204), because of the heat treatment (104). In some example embodiments, the heat treatment may be performed as two successive heat treatments (106 and 108), wherein the first heat treatment (106) may include annealing the solid material alloy (216) to initiate the diffusion or segregation of the dopant element (208) to the grain boundary (204), followed by a second heat treatment (108) to create an amorphous phase at the grain boundary (204). Herein, the dopant element (208) may be substantially depleted at each crystalline interior (202) after application of the first heat treatment (106). In some examples, the crystalline interior may be about at least 90% depleted of the dopant element (208). In some more examples, the crystalline interior may be about at least 95% depleted of the dopant element (208).

Figures 2A, 2B, 2C, 2D:
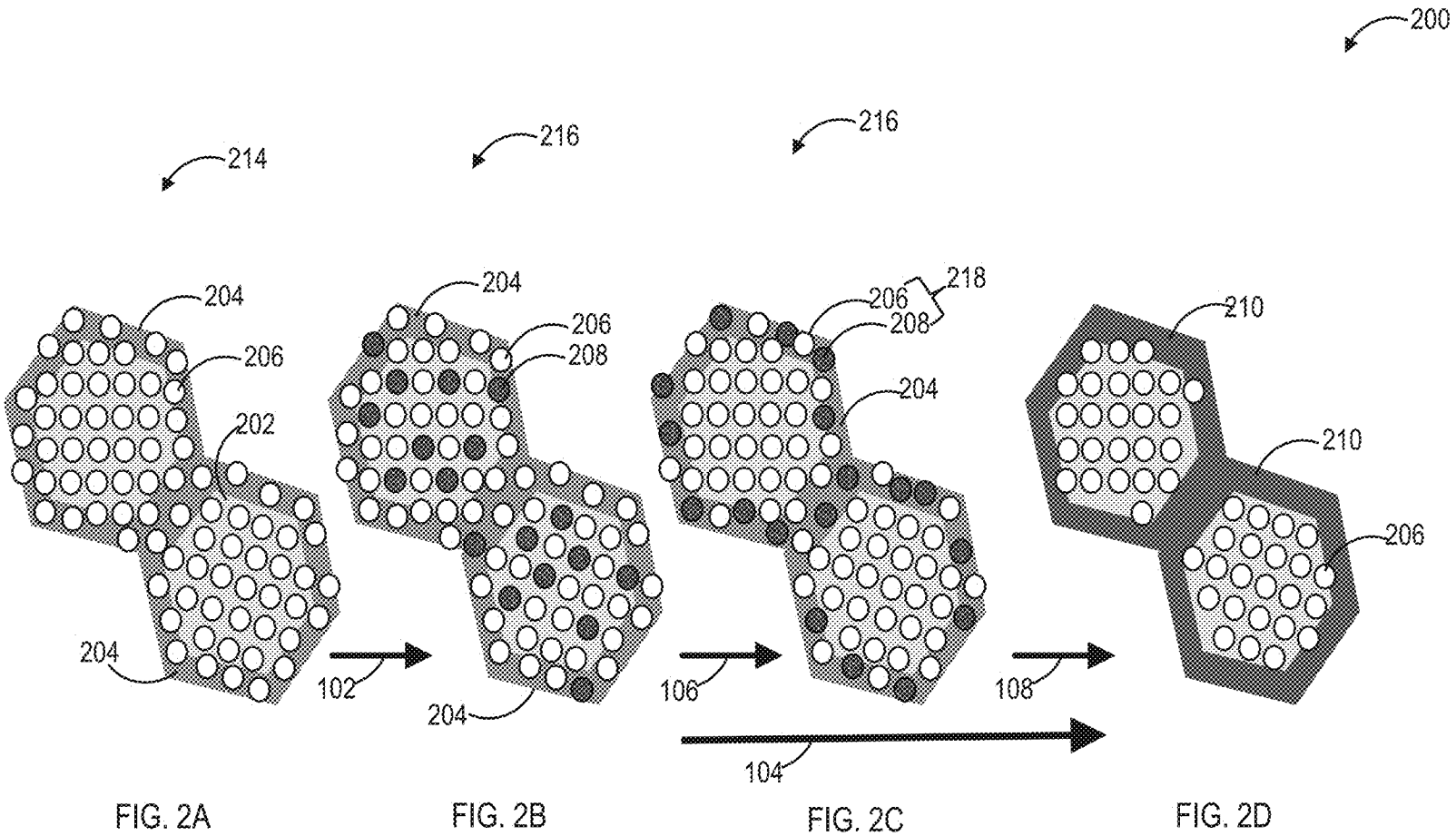
FIGS. 2A-2D show a schematic diagram of the AIF formation in the nanocrystalline sample.

In addition, the grain boundaries (204) may be saturated or enriched with the dopant material (208), as shown in FIG. 2C. material. The dopant element may prefer to be at the boundaries in the base material so that dopant elements diffuse from the crystalline interior (202) and settle at the grain boundaries (204). Diffusion occurs because the dopant segregation lowers the boundary and overall system energy, which improves the thermal stability of the nanostructured material [5]. In some examples, the nanostructured materials may be stable up to 950° C., which may be 98% of the melting temperature, as shown further below. In order to introduce AIF into the nanostructured material, elemental combinations that lower the formation energy of an amorphous phase yet retain metallic bonding are desired. Salient features of these combinations typically, but not always, may have the following characteristics: 1) negative heats of mixing for all elemental pairs, 2) large atomic radius mismatch between elements, 3) retention of the metallic bonding at the crystal boundary, and 4) negative heat of segregation. Such a material design strategy may be applied to base elements such as copper, iron (or steels), nickel, titanium, and other transition metals, as well as non-transition metals such as aluminum and magnesium. Some non-limiting examples of the dopant element includes Zr, Fe, Co, Ni, Rh, Pd, Pt, and any non-transition or transition metals which are known to one of ordinary skill in the art. A specific example with the strategy being applied to copper is discussed further below.

When the second heat treatment (108) is applied to the solid material, the amorphous phase created may be a liquid-like structure comprising the dopant element (208) and the base material (206). The second heat treatment (108) may selectively create the liquid-like structure in the grain boundary (204) while maintaining a crystalline interior (202) solid. Without wishing to limit the invention to a particular theory or mechanism, because the grain boundary is doped, it has a different composition than the grain interior and melts at a lower temperature. Therefore, a temperature above the critical value for grain boundary pre-melting but below the bulk melting temperature is required. Thus, the region at the grain boundary, which is chemically comprised of both the base material and the dopant element, is the only thing that melts during the heat treatment.

As an example, the first heat treatment (106) may include annealing the solid material alloy (216) at a first temperature for a first threshold time, and the second heat treatment (108) may include further annealing the solid material alloy (216) at a second temperature for a second threshold time. One of ordinary skill in the art would understand and appreciate that said temperatures and times can depend on several factors. For example, the first temperature and the first threshold time may be selected based on one or more of the base material, the dopant element, grain size, and a phase diagram of the solid material alloy. In one example embodiment, the second temperature may be higher than the first temperature. In examples where a single heat treatment (104) is performed, the first temperature may be the same as the second temperature. In an example embodiment, the first and the second temperature may be adjusted based on a melting temperature of each of the base material (206) and the dopant element (208), a solidus temperature of the solid material alloy, and a phase diagram of the solid material alloy. In one example embodiment, the first and the second threshold temperature may be set to be higher than a temperature that induces grain boundary pre-melting but is below a bulk melting temperature. In one non-limiting example, for a Cu—Zr alloy, the first threshold temperature may be set as 950° C. and the second threshold temperature may be set as 500° C., and the first and second threshold time may be 1 hour.

Next, at 110, method 100 includes quenching the solid material alloy (216) to freeze the liquid-like structure to form a plurality of amorphous intergranular films (AIFs) (210) at the grain boundaries (204). After quenching, the plurality of AIFs (210) are observed at the grain boundaries (204). In one example embodiment, quenching may include quickly decreasing the temperature from the second temperature to a third, lower temperature, in a short time. In one non-limiting example, the third temperature may be about room or ambient temperature (about 20° C.). For example, the solid material may be quenched by placing the solid material into a large water bath at room temperature, in less than a second, to quickly freeze the structures in the interfacial mixture. AIFs are structurally disordered (lacking the ordered pattern of a crystal) films that are up to a few nanometers thick. Nanostructured materials containing these films exhibit increased ductility, strength, and thermal stability simultaneously. As an example, the AIF formation in a copper-zirconium (Cu—Zr) alloy is shown below.

Example. Amorphous Intelgranular Films in a Nanocrystalline Cu-Based Alloy

The following is a non-limiting example of the present invention. It is to be understood that the examples described herein are not intended to limit the invention in any way. Equivalents or substitutes are within the scope of the invention.

Described in the present invention are amorphous intergranular films formed within nanostructured materials. Nanostructured materials, (materials with average grain size of less than 1 micron), have exceptional properties (e.g. high strength) and are the focus of recent research of engineering applications. The addition of amorphous intergranular films dramatically changes physical and mechanical properties of nanostructured materials. The present method of creating amorphous intergranular films is based on mixing two or more elements and inducing dopant elements to segregate to the crystal boundaries of the base element. To show the formation AIFs in a nanostructured material, pure copper ("Cu") powder was mixed with 3% pure zirconium ("Zr") powder using a ball milling instrument, which agitates and co-deforms the powders so that they mechanically mix. It may be appreciated that this material design idea is not specific to ball milling or mechanical alloying, but rather can be used for any processing method. Cu and Zr were chosen for this example since, based on the standard phase diagram of the two elements, segregation is expected due to limited miscibility of Zr in the base Cu. However, by using a high energy ball milling technique, a super saturated solid solution of these elements is possible. The Cu—Zr alloys thus produced were found to be stable to 950 degrees C., which is 98% of the melting temperature. This is among the highest reported stability for these materials.

Figure 3:
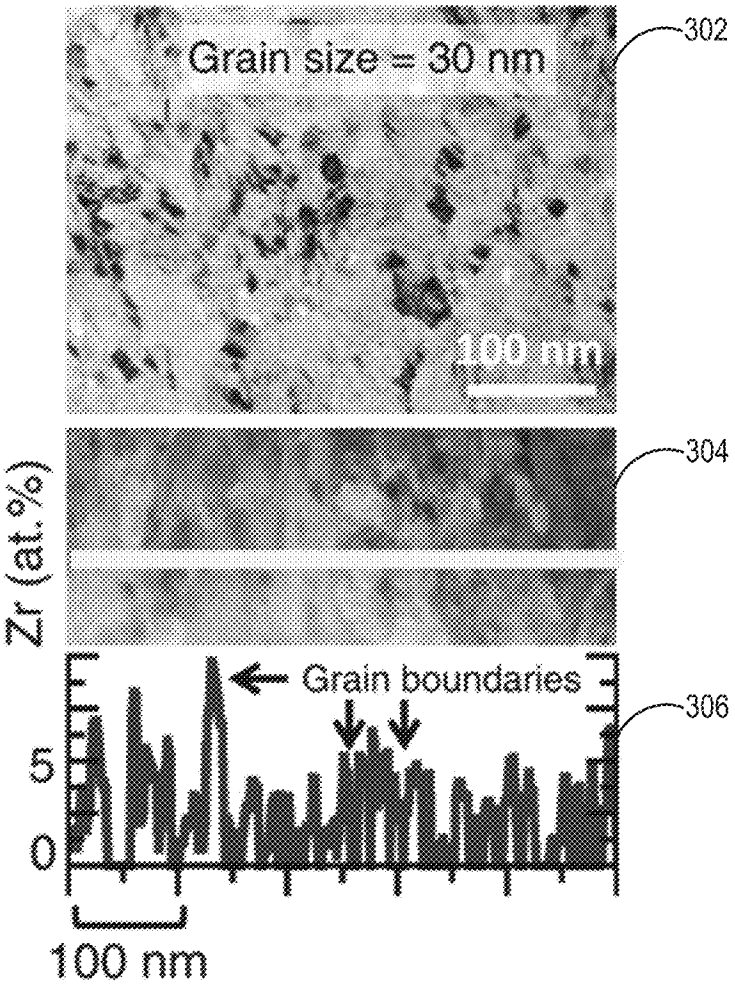
FIG. 3 shows a transmission electron microscope (TEM) image and an energy dispersive x-ray spectroscopy of as-milled Cu—Zr powders.

In one example embodiment, the base material (206) in FIGS. 2A-2D may be Cu and the dopant element (208) may be Zr. FIG. 2B shows the schematic of the powders' microstructure after a complete homogenous mixing. There is no preference on the position of Zr atoms at the crystallite ("grain") boundaries of the Cu nanostructure. However, by applying a special heat treatment at high temperatures, all the Zr atoms segregate to the grain boundaries. A fast quench from high temperature to very low temperature freezes the new phases formed at the grain boundary. FIG. 3 shows transmission electron microscope (TEM) image (302) and TEM image (304) of the as-milled Cu—Zr nanostructure at different magnifications (scale bar is 100 nm). There is a uniform distribution of grain size and the average grain size of the as-milled Cu—Zr alloy is 30 nm. The energy dispersive x-ray spectroscopy (EDS) line profile (306) in FIG. 3 shows that the Zr distribution is uniform across the grains.

After the solid solution alloy is made, a heat treatment step gives the Zr atoms thermal energy to segregate to the crystal boundaries of the nanostructured Cu, which is schematically shown in FIG. 2C. Then, the material is further heated to promote melting of the interfacial mixture, while the crystallite interior remains solid. This suggests that high temperatures close to, but below, the melting temperature are beneficial. This interface melting step can, in some cases, be the same heat treatment used to promote segregation. As an example, the solid solution alloy may be annealed at 950° C. for 1 hour. This temperature is extremely high for Cu and Cu—Zr alloys, being about 90% of the melting temperature of pure Cu and about 98% of the solidus temperature (where the material begins to melt) of Cu-3 atomic % Zr. During annealing, Zr diffuses to the grain boundaries, as shown by the EDS profile (406) in FIG. 4, where two examples of grain boundaries are labelled. The TEM images (402 and 404) show the grain size of Cu—Zr alloy is 45 nm. The high-temperature annealing treatment used to induce Zr segregation is also useful for promoting AIF formation. Afterwards, the Cu—Zr alloy is quenched very quickly, about 5 minutes, to freeze the liquid-like interfacial structure that was formed at high temperatures. FIG. 2D shows the final atomic structure of the nanostructured alloy. Some grain boundaries were in the right condition for the formation of amorphous intergranular films. In this case, the annealing was done under vacuum to avoid oxidation of the Cu—Zr alloy. An amorphous intergranular film with thickness of 5.7 nm was observed at a grain boundary after quickly quenching from 950° C. (shown in FIG. 6).

Figure 4:
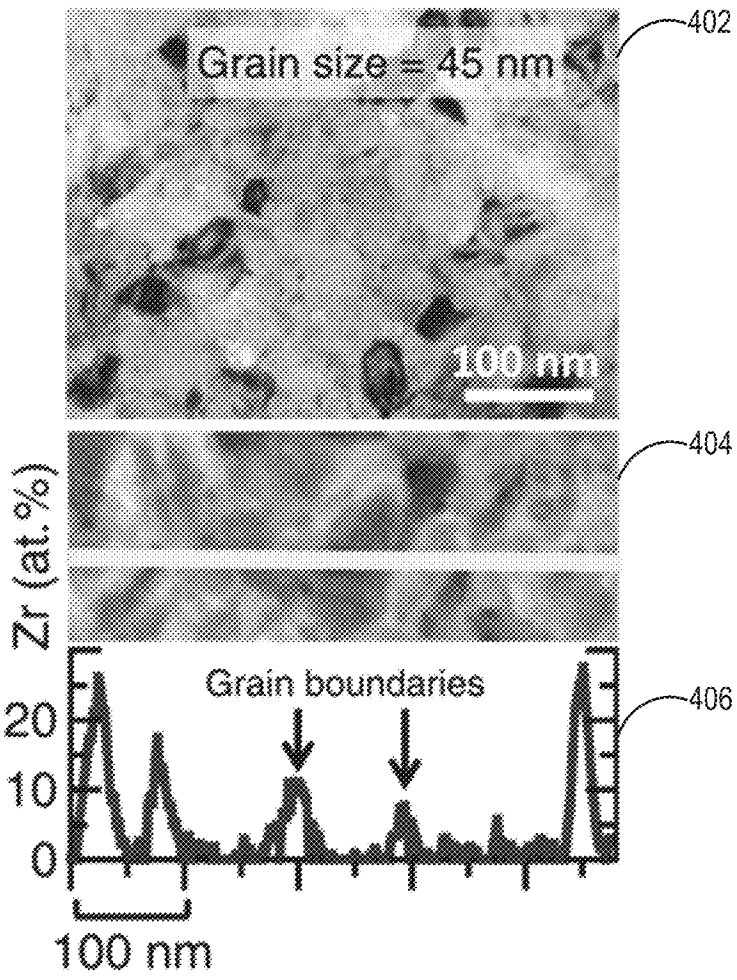
FIG. 4 shows the transmission electron microscope and the energy dispersive x-ray spectroscopy of the heat treated Cu—Zr powders.
Figure 5:
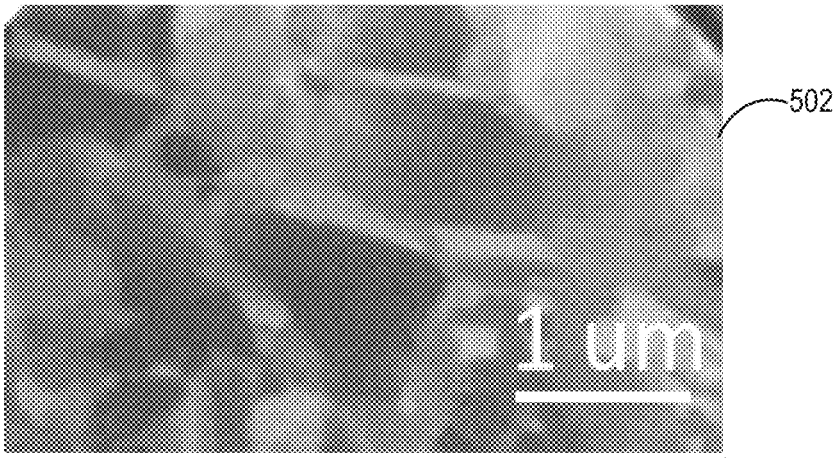
FIG. 5 shows a focused ion beam (FIB) channeling image of a pure Cu microstructure after annealing for 1 hour.
Figure 6:
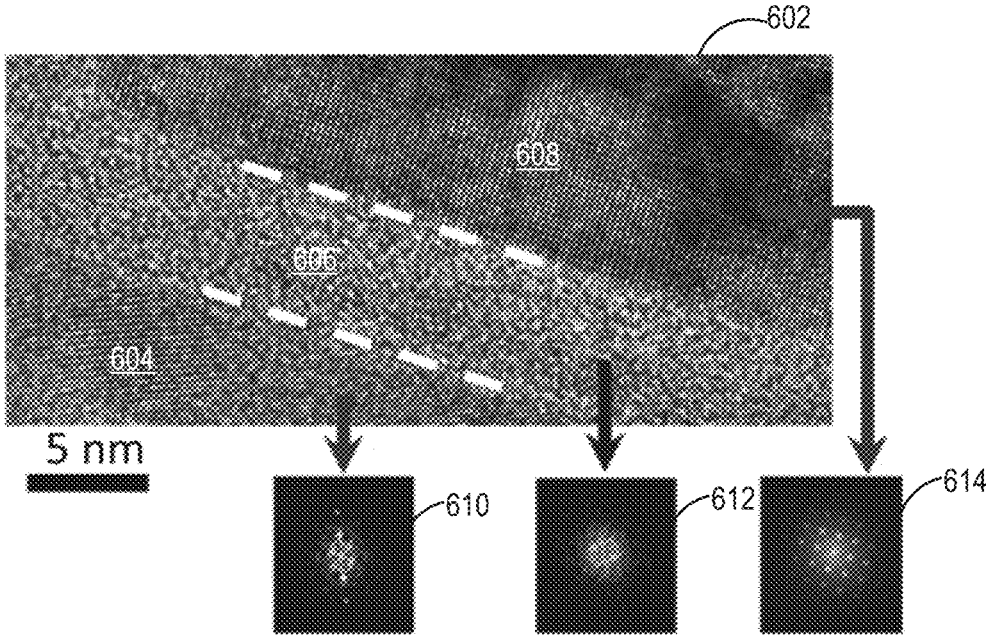
FIG. 6 shows a high-resolution TEM image of the AIF at the grain boundary of the Cu—Zr nanocrystalline.

The segregation of the dopant element (Zr) from the base material (nanostructured Cu) lowers the crystal boundary energy of the microstructure, making the material more resistant to high temperature. The grain structure of the Cu—Zr alloy after the heat treatment is shown in FIG. 4. It may be appreciated that even by heat treating nanocrystalline Cu—Zr at 98% of its melting point for a period of one week, only little grain growth was observed which shows a resistant microstructure to grain growth. Without segregating dopants, and under the same heat treatments, a nanostructured pure Cu would coarsen until the crystals were larger than 1 micron. This effect can be seen in image (502) of FIG. 5, which shows the microstructure of a nanocrystalline pure Cu after annealing. Due to the excessive grain growth in pure Cu, the material is no longer nanostructured. The energy dispersive spectroscopy ("EDS") line profile (406) of FIG. 4 shows the preferential segregating of Zr atoms to the grain boundaries of Cu. The Zr atomic % concentration reaches 10-20% at the grain boundaries while the concentration of Zr at the grain interior is almost zero. During the heat treatment process, a new crystal boundary structure, the AIF, is created. An example of an amorphous intergranular film is shown in FIG. 6. Fresnel fringe imaging was used to identify interfacial films, followed by high-resolution TEM for detailed characterization of grain boundary structure and measurement of AIF thickness. A representative example of an AIF is presented in image (602) of FIG. 6. The areas in the bottom left (604) and top right (608) of FIG. 6 are crystalline, as shown by the presence of lattice fringes in the image (602) as well as sharp spots in the fast Fourier transform patterns (610 and 614), which denote periodic order associated with the lattice. FFT analysis is an image analysis method that can be used to find periodic features in an image. Period structures in the image not visible to the eye will be picked up by the FFT algorithm and shows up as bright dots in the FFT image. In contrast, the region at the interface (606), between the two dashed lines, is amorphous and disordered with a thickness of 5.7 nm. The fast Fourier transform pattern (612) shows no sign of long-range crystalline order in this case and is completely featureless. This structurally disordered region is the AIF. The FFT analysis in the image confirms that there is no long range order (i.e., crystalline order) at the interface (see 612). This image provides the first proof that it is possible to form amorphous intergranular films in nanostructured materials.

Figures 7A, 7B, 7C, 7D, 7E, 7F, 7G, 7H, 7I:
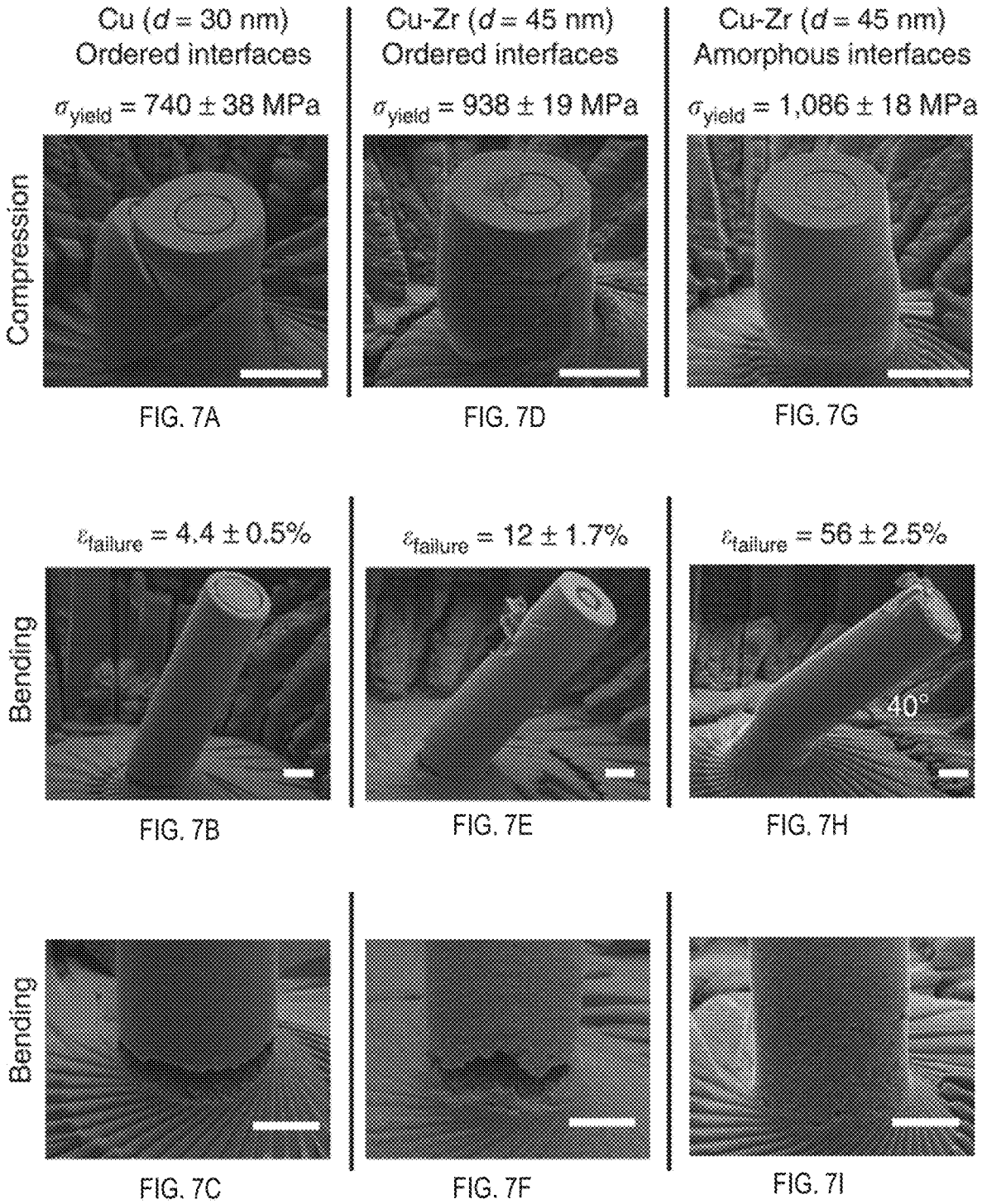
FIGS. 7A-7I show a comparison of strength and ductility of pure Cu, Cu—Zr mixed, and nanostructured Cu—Zr with AIFs.

Next, mechanical properties of the Cu—Zr alloy with AIFs were compared with a pure nanostructured Cu, and a nanostructured Cu—Zr of the same composition (but without AIFs, i.e., having ordered interfaces). Micron-size pillars were made from each material type using a focused ion beam microscope. These pillars were then tested in compression and bending modes to measure compressive strength and strain-to-failure values, respectively. FIGS. 7A and 7D show that both the pure nanocrystalline Cu and the Cu—Zr alloy with ordered interfaces are brittle in nature and fracture easily in bending and compression tests. However, FIGS. 7G-7I show that the Cu—Zr alloy containing amorphous intergranular films has a high ductility and never forms a full crack (only scattered formation of small voids on the surface). Experiments also showed that the Cu—Zr nanostructured alloy with amorphous intergranular films reached a strain-to-failure value of 56% and exhibited a yield strength of 1 GPa. In contrast, the pure nanostructured Cu showed a yield strength, or $\sigma_{yield}$ of 740 MPa and a strain-to-failure value of 4.4%. This is significant because nanocrystalline materials have never been observed to behave in this manner under an applied load.

Figure 8:
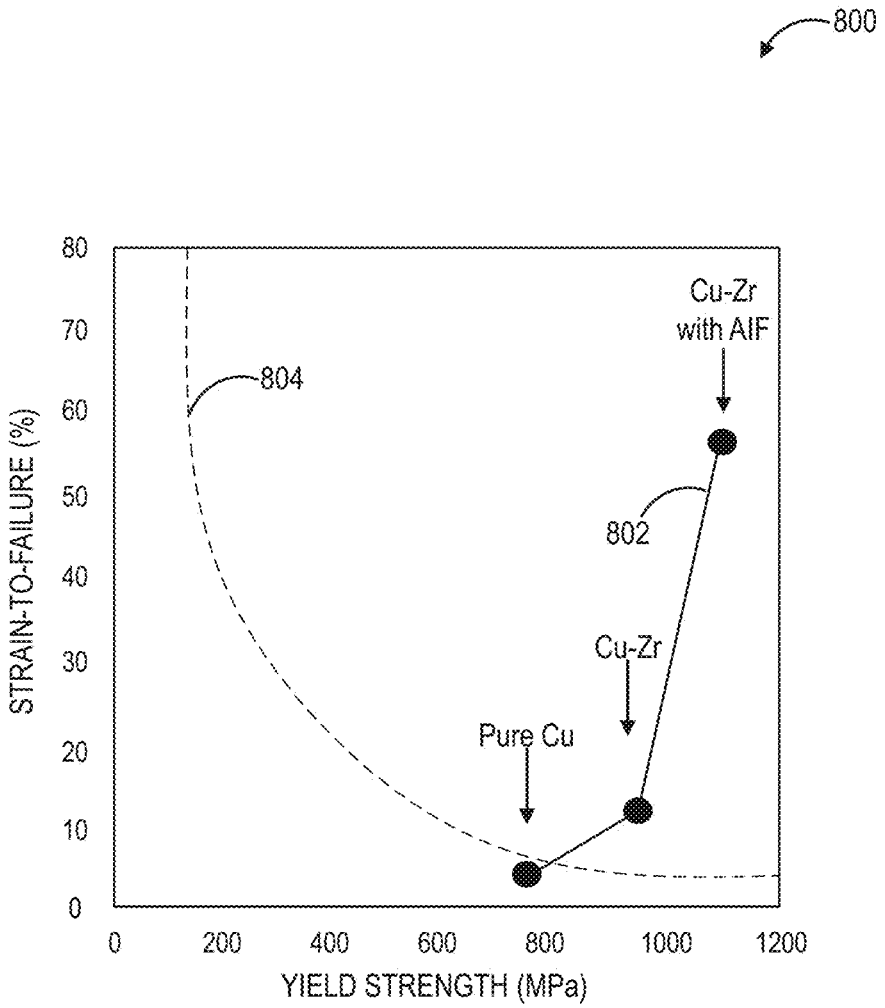
FIG. 8 shows an example relationship between a strain-to-failure percent and a yield strength of pure Cu, Cu—Zr, and Cu—Zr with AIF.

To explain this phenomenon, plastic deformation in nanocrystalline metals is studied. Without wishing to limit the invention to a particular theory or mechanism, traditional dislocation mechanisms are suppressed at the grain sizes observed in this study. Dislocations nucleate at the grain boundaries and get absorbed at the grain boundaries. Since a regular grain boundary cannot absorb many dislocations, a crack nucleates along the crystal boundary path and eventually causes catastrophic failure in a regular nanostructured metal [6]. However, in a nanostructured material with amorphous intergranular films, the crystal boundary is disordered and has a finite thickness to it. Therefore, it can absorb more dislocation and delays the formation of a crack, which corresponds to the added ductility. FIG. 8 shows data on the ductility of coarse-grained and nanostructured Cu and Cu-based alloys (plot 802). As can be seen from FIG. 8, the nanostructured Cu—Zr with amorphous intergranular films breaks the paradigm of the ductility-strength (plot 804) problem in nanostructured materials.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the below claims are solely for ease of examination of this patent application, and are exemplary, and are not intended in any way to limit the scope of the claims to the particular features having the corresponding reference numbers in the drawings. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

REFERENCES

[1] J. A. Sharon et al., *J. Mat. Research.* 28, 12 (2013).
[2] K. Lu et al., *Scrip. Metal. Mater.* 24, (1990).
[3] L. Lu et al., *Science* 304, 5669 (2004).
[4] I. S. Choi et al., *J. Mech. Phys. Sol.* 56, 1 (2008).
[5] T. Chookajorn et al., *Science,* 24, 337 (2012).
[6] Pan, Z. & Rupert, T. J. Damage nucleation from repeated dislocation absorption at a grain boundary. *Comput. Mater. Sci.* 93, 206 (2014).

What is claimed is:

1. A method for increasing thermal stability and ductility of a nanostructured material (214), said nanostructured material comprising a base material (206) in a form of a plurality of crystallites each having a boundary ("crystallite boundary") (204) defining a crystalline interior (202), wherein the method comprises:

(a) selecting a dopant element (208) compatible with the base material (206) such that:
  i. the dopant element (208) and the base material (206) are immiscible;
  ii. the dopant element (208) has a negative heat of mixing;
  iii. an atomic size difference between the dopant element (208) and the base material (206) is sufficiently large to cause disorder at the crystallite boundaries of the nanostructured material (214); and
  iv. metallic bonding is retained at the crystallite boundary;

(b) mixing (102) the dopant element (208) and the base material (206) to produce a supersaturated solid material alloy (216), wherein the dopant element (208) is dispersed throughout the crystallite boundaries (204) and crystalline interiors (202);

(c) applying a first heat treatment (106) to the supersaturated solid material alloy (216) to provide thermal energy sufficient to induce diffusion of the dopant element (208) to the crystallite boundaries (204), wherein the crystalline interiors (202) are substantially depleted of the dopant element (208) after application of the first heat treatment (106);

(d) applying a second heat treatment (108) to create an amorphous structure at the crystallite boundaries (204), wherein the amorphous structure comprises the dopant element (208) and the base material (206), wherein the crystalline interiors (202) remains solid during the second heat treatment (108); and (e) quenching (110) the supersaturated solid material alloy (216) to freeze the amorphous structure, thus forming amorphous intergranular films (AIFs) (210) at the crystallite boundaries (204);

wherein segregation of the dopant element (208) via the diffusion of the dopant element (208) to the crystallite boundaries (204) lowers a crystal boundary energy, thereby making the nanostructured material stable at temperatures below the melting temperature of the nanostructured material, wherein the formation of the AIFs at the crystallite boundaries (204) of the nanostructured material (214) increases both strength and ductility of the nanostructured material (214) as compared to materials lacking AIFs.

2. The method of claim 1, wherein the mixing (102) comprises agitating and co-deforming powders of the base material (206) and the dopant element (208) to mechanically mix the base material (206) and the dopant element (208).

3. The method of claim 2, wherein the agitating and co-deforming is performed using a ball-milling instrument.

4. The method of claim 1, wherein applying the first heat treatment (104) comprises annealing the supersaturated solid material alloy (216) at a first temperature for a first threshold time and wherein applying the second heat treatment (108) comprises annealing the supersaturated solid material alloy (216) at a second temperature for a second threshold time.

5. The method of claim 4, wherein the second temperature is greater than or equal to the first temperature.

6. The method of claim 4, further comprising selecting the first temperature, the second temperature, the first threshold time, and the second threshold time based on one or more of the base material (206), the dopant element (208), and a phase diagram of the supersaturated solid material alloy (216).

7. The method of claim 1, wherein the supersaturated solid material alloy (216) comprises two or more dopant elements.

8. The method of claim 1, wherein the supersaturated solid material alloy (216) comprises two or more base materials.

9. The method of claim 1, wherein the dopant element (208) comprises Zr, Fe, Co, Ni, Rh, Pd, Pt, other transition metals, or non-transition metals.

10. The method of claim 1, wherein the base material (206) comprises Cu, Fe, steel, Ni, Ti, other transition metals, Al, Mg, or other non-transition metals.

11. A method of forming an amorphous intergranular film ("AIF") (210) surrounding crystallite structures of a base material (206) of a nanostructured material (214), wherein the crystallite structure comprises a crystalline interior (202) having a grain boundary (204), the method comprising:

a. mixing (102) a dopant element (208) with the base material (206) to form a solid material alloy (216), the dopant element (208) selected based on:

i. an ability of the dopant element to segregate to the grain boundary (204) of the base material (206), ii. the dopant element (208) and the base material (206) being immiscible; and iii. an atomic size difference between the dopant element (208) and the base material (206) being sufficiently large to cause disorder at the crystallite boundaries of the nanostructured material (214);

b. applying a heat treatment (104) to the solid material alloy (216) to preferentially segregate the dopant element (208) to the grain boundary (204) and to selectively melt an interfacial mixture (218) at the grain boundary (204) to form a structure at the grain boundary (204); and c. quenching (110) the solid material alloy (216) to freeze the structure of the interfacial mixture (218) at the grain boundary (204), while maintaining the crystalline interior (202) solid, wherein the AIF (210) formed at the grain boundary (204) of the base material (206) increases strength, ductility, and thermal stability of the nanostructured material (216).

12. The method of claim 11, wherein applying the heat treatment (104) includes annealing (106) the solid material alloy at a threshold temperature for a threshold time to diffuse the dopant element (208) to the grain boundary (204) of the base material (206) and melt the dopant element (208) and the base material (206) in the interfacial mixture (218) to form the AIF (210) at the grain boundary (204).

13. The method of claim 12, wherein the threshold temperature adjusted based on a melting temperature of each of the base material (206) and the dopant element (208).

14. The method of claim 11, wherein the base material (206) comprises copper ("Cu"), and the dopant element (208) comprises zirconium ("Zr") and wherein the solid material alloy (216) is a Cu-3 atomic percent Zr alloy.

* * * * *